US008026784B2

(12) United States Patent
Körner

(10) Patent No.: US 8,026,784 B2
(45) Date of Patent: Sep. 27, 2011

(54) GANGED POWER CIRCUIT SWITCHES FOR ON-BOARD ELECTRICAL SYSTEM IN MOTOR VEHICLES

(75) Inventor: André Körner, Lippstadt (DE)

(73) Assignee: Hella KGAA, Lippstadt (DE)

( * ) Notice: Subject to any disclaimer, the term of this patent is extended or adjusted under 35 U.S.C. 154(b) by 768 days.

(21) Appl. No.: 11/835,087

(22) Filed: Aug. 7, 2007

(65) Prior Publication Data

US 2009/0038918 A1 Feb. 12, 2009

(51) Int. Cl.

| | |
|---|---|
| ***H01H 61/00*** | (2006.01) |
| ***H01H 71/16*** | (2006.01) |
| ***H01H 3/00*** | (2006.01) |
| ***H01H 65/00*** | (2006.01) |

(52) U.S. Cl. ..... 337/44; 337/16; 337/101; 337/42; 200/18; 29/622

(58) Field of Classification Search ..... 337/333, 337/16, 42, 44, 101; 29/622; 200/18
See application file for complete search history.

(56) References Cited

U.S. PATENT DOCUMENTS

| | | | | | |
|---|---|---|---|---|---|
| 1,942,327 | A | * | 1/1934 | Drake | 455/233.1 |
| 3,400,232 | A | * | 9/1968 | Mathey | 200/18 |
| 3,673,531 | A | * | 6/1972 | Zane | 337/77 |
| 3,688,060 | A | * | 8/1972 | Risk | 200/409 |
| 3,711,726 | A | * | 1/1973 | Wiechert | 307/117 |
| 3,713,062 | A | * | 1/1973 | Butler et al. | 337/107 |
| 3,715,004 | A | * | 2/1973 | Pasek et al. | 180/271 |
| 3,743,179 | A | * | 7/1973 | Grayson | 236/15 A |
| 3,787,793 | A | * | 1/1974 | Willson | 337/44 |
| 3,815,001 | A | * | 6/1974 | Jamieson | 318/139 |
| 3,907,238 | A | * | 9/1975 | Sibley et al. | 246/34 R |
| 3,912,906 | A | * | 10/1975 | McIntosh et al. | 219/486 |
| 4,030,066 | A | * | 6/1977 | White | 340/476 |
| 4,159,155 | A | * | 6/1979 | Heydner | 337/89 |
| 4,159,753 | A | * | 7/1979 | Boche | 180/170 |
| 4,220,939 | A | * | 9/1980 | Grable | 337/94 |
| 4,234,956 | A | * | 11/1980 | Adderley et al. | 375/260 |
| 4,325,046 | A | * | 4/1982 | Burch | 337/56 |
| 4,346,564 | A | * | 8/1982 | Gemma et al. | 62/140 |
| 4,384,314 | A | * | 5/1983 | Doty et al. | 361/160 |
| 4,423,400 | A | * | 12/1983 | Marcoz | 337/72 |
| 4,424,506 | A | * | 1/1984 | Burch | 337/365 |
| 4,453,161 | A | * | 6/1984 | Lemelson | 340/5.63 |
| 4,842,419 | A | * | 6/1989 | Nietert | 374/145 |
| 4,859,979 | A | * | 8/1989 | Jacquet | 337/3 |
| 5,038,086 | A | * | 8/1991 | Ahmed et al. | 318/286 |
| 5,040,097 | A | | 8/1991 | Stribel | |
| 5,140,235 | A | * | 8/1992 | Ahmed et al. | 318/286 |
| 5,149,924 | A | * | 9/1992 | Priesemuth | 200/5 R |
| 5,237,303 | A | * | 8/1993 | Kicherer et al. | 337/99 |

(Continued)

FOREIGN PATENT DOCUMENTS

EP 1033288 A2 9/2000

*Primary Examiner* — Bradley Thomas
(74) *Attorney, Agent, or Firm* — Robert C. Haldiman; Husch Blackwell LLP

(57) ABSTRACT

This current invention is about a switching implement enabled to perform the remote-controlled switching of electric consumers, consisting of multiple electro-mechanical bistable switches, plus at least one actuating element allocated to the bistable switches such that it can selectively change the state of any of the bistable switches from one of its two states to the other and vice versa.

20 Claims, 7 Drawing Sheets

U.S. PATENT DOCUMENTS 5,291,103 A * 3/1994 Ahmed et al. ..... 318/3
5,331,260 A * 7/1994 Ahmed ..... 318/282
5,825,273 A * 10/1998 Roger ..... 337/49
5,861,793 A * 1/1999 Hatton ..... 337/229
6,016,096 A * 1/2000 Barnes et al. ..... 337/123
6,049,267 A * 4/2000 Barnes et al. ..... 337/123
6,078,243 A * 6/2000 Barnes et al. ..... 337/140
6,133,816 A * 10/2000 Barnes et al. ..... 337/123
6,342,826 B1 * 1/2002 Quinn et al. ..... 337/300
6,572,184 B2 * 6/2003 Bauer et al. ..... 296/223
6,833,517 B2 * 12/2004 Sotome et al. ..... 200/5 R
2004/0066096 A1 * 4/2004 Pearson et al. ..... 307/132 R
2004/0227483 A1 * 11/2004 Katsumata et al. ..... 318/469
2005/0212491 A1 * 9/2005 Colombo et al. ..... 320/150
2007/0188846 A1 * 8/2007 Slicker et al. ..... 359/290

* cited by examiner

GANGED POWER CIRCUIT SWITCHES FOR ON-BOARD ELECTRICAL SYSTEM IN MOTOR VEHICLES

BACKGROUND OF THE INVENTION

1. Field of the Invention

The invention presented herein is about a switching implement suitable for the remote-controlled switching of electrical components.

2. Related Art

The invention presented herein is about a switching implement suitable for the remote-controlled switching of electrical consumers. Standard vehicle configurations feature one or two fuse and relay boxes for frequently switching or small to medium loads. Many of these fuse and relay boxes are so-called smart junction boxes with an extra circuitry and sometimes included semiconductor switches.

A switching implement of this kind is described in EP 0 181 534 131 and other publications. This type of switching implement with its many relays and blow-out fuses for protection requires a fairly elaborate design and is of limited reliability due to its many fuses, relays and plug connections. It also leads to comparatively much power being lost during operation because every fuse, every relay coil, every relay contact, and every contact dissipates some of the power. Since the plug-in fuses need to be replaced every time a situation occurs that their job is to protect the vehicle against (e.g. overload or short circuit), the entire switching implement needs to be installed at a place in the vehicle where it can be accessed for maintenance.

The state of the art has revealed maintenance-free switching implements using semiconductor switches for actuating the electrical consumers, However, the highcurrent switching transistors deployed in these switching implements are very expensive. Thermal bimetal switching devices failed to become the standard means of overload and short-circuit protection because their design-specific disadvantages disallow their general use in motor vehicles.

EP 1 033 288 A1 describes a fusing system featuring a motor-driven actuator which can be remote controlled to reversibly break the contact of multiples lines. However, this fusing system allows but a single set sequence of on or off switching actions regarding the consumer lines. The fusing system with its single actuator fails to independently switch the different consumers on or off. Another fact is that having a motor break the contacts slows down the process of breaking the contacts whose long arc durations as specifically generated by short circuit currents will wear down the contacts faster, thereby shortening the life of the contacts.

Hence, the task of the current invention is to provide a switching implement for the remote-controlled switching of electrical components or groups of components, where the continuous power loss of the implement rates significantly lower than that of conventional fuse and relay boxes, where the design of the implement is of a small footprint, robust and cost-effective, and where the means of protection against overload and short circuit can be re-actuated which allows the switching implement to be installed in less accessible places in the vehicle.

SUMMARY OF THE INVENTION

The current invention accomplishes its objective by a switching implement of the aforementioned type.

The invention is about a switching implement for the remote-controlled switching of electrical consumers comprising:

- multiple electromechanical, bistable switches each of which can be set to a first state and at least a second state and vice versa;
- at least one actuating element which is allocated to the bistable switches and able to selectively set the bistable switches to one of the two logical states.

The switching implement according to the invention is specifically designed for use in vehicles and is of a comparatively simple, robust and cost-efficient design compared with that of the fuse and relay boxes mentioned in the State of the Art section hereof. To turn off overloads and short circuits, the switching implement uses switches which can be reactivated and, thus, need not to be replaced after performing their protective action. Thus, the switching implement can be installed in relatively inaccessible places in the vehicle. Deployment of the switching implement as a replacement for a conventional fuse and relay box or as a module of an intelligent fuse and relay box can help reduce the space, material and mass of the module required to actuate the electrical consumers and to electrically protect the wiring connecting up the electrical consumers. The electromechanical, bistable switches may feature a moving switch contact holder holding at least one electrical switch contact and at least one immobile switch contact holder holding at least one switch contact. The moving switch contact holder could be a flexible switching contact spring, for example. Moving the bistable switch to the Closed position will make the switch contacts contact at a force allowing electric current to pass through the switch. Moving the switch to the Open position will force the switch contacts apart leaving a specified minimum contact clearance that will interrupt the flow of electric current. Designing the switches as bistable switches allows consumers or omnibus circuits, which normally remain connected to the onboard mains of the vehicle, to be selectively separated from the on-board mains in response to certain situations of the vehicle, e.g. parking for extended periods of time, loading the vehicle on-board a vessel, a nearly discharged battery, etc. Separation from the mains would require no separate bistable electrical relay or separate semiconductor switch for each of these consumers.

A specifically beneficial design variant suggests to design the at least one actuating element such that it can make two entirely independent movements that will allow to toggle each of the bistable switches to any of its logical states. The multiple bistable switches of the switching implement could be arranged in a line or in a circular arrangement. Or there is a possibility of arranging the bistable switches at several layers one on top of each other. The at least one actuating element of the switching implement is designed such that each of the bistable switches can be selectively actuated either in a movement of translation or a movement of rotation or a combined movement of translation and rotation.

Another design variant may extend the switching implement by an electronic control unit which is set to controlling the at least one actuating element with reference to external control signals. The electronic control unit could have at least one communication port connecting it with the on-board electrical system of the vehicle. If a request is received through the communication port to turn one of the bistable switches on or off, the actuating element can be moved to the relevant bistable switch. The bistable switch will be actuated and set to the requested switching state.

Another beneficial design variant suggests to set up the at least one actuating element for a non-contact switchover of the bistable switches.

The at least one actuating element may have at least one means of activation and at least one means of setting the position of the at least one means of activation.

The bistable switches may feature at least one means of operation by which the at least one means of activation of the actuating element can be manipulated. For example, the means of operation could have an operating section which makes up an integral unit with the moving switch contact holder of the bistable switch.

To allow for a non-contact activation of the bistable switches, the design may specify the at least one means of activation to be a solenoid. A solenoid will reliably ensure a non-contact switchover of the bistable switches of the switching implement if the means of operation of the switching bistable switches is set by means of magnetic force (for example from a ferromagnet or a permanent magnet).

To allow the reading in of the logical states of the bistable switches or the consumers connected to them during operation of the switching implement, a particularly beneficial design variant could include sensor elements in the switching implement where the sensor elements would be able to measure the temperature of the bistable switches and/or the current going through the bistable switches.

The sensor elements could be integrated in the bistable switches, for example. Deploying preferably electronic means of measuring the currents, short circuits and currents above admissible limits could be detected with reference to custom current vs. time characteristics and, once detected, could be interrupted by the actuating element. The turn-off characteristic of currents over time could thus be adapted to the admissible current vs. time characteristic of every consumer, wire or other component connected to the system at any point along the load line. Keeping track of load currents may allow the switching implement to also provide a master system for the vehicle's mains energy management with information about load currents and other details to support quiescent current management, energy consumption management and other energy management functions. This turns the switching implement into an intelligent, mechatronic feedback system.

To prevent the bistable switches or the electrical consumers connected to them from taking damage, a particularly beneficial design variant suggests protecting at least some of the bistable switches by means appropriately configured to turn off a bistable switch exposed to a temperature and/or a current in excess of the set maximum. Integrating a fuse function and a relay function into the bistable switches helps to reduce the efforts otherwise necessary to provide these functions as well as the efforts otherwise necessary to provide the appropriate electrical connections.

For example, the safety equipment may be made up of a bimetal actuator located inside the bistable switch or immediately attached to the bistable switch. A bimetal actuator can be fairly easily integrated in the bistable switch and would facilitate the reliable turn-off of the bistable switch in response to the temperature in the switch being above a set critical limit.

A particularly beneficial design variant suggests having the switching implement include means of reading the ambient temperature of the bistable switches and means of reading the mains voltage of the vehicle's on-board mains, and having these means be connected to the electronic control unit. This design would further improve the accuracy of electric current analyses. After measuring the ambient temperature of the bistable switches preferably using one or several temperature sensors and after measuring the on-board mains voltage, the readings are fed to the electronic control unit which will take care of their further processing.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The description of design variants below illustrates further features and benefits of the current invention with reference to the attached figures. The following is shown.

DETAILED DESCRIPTION OF THE PREFERRED EMBODIMENTS

The following description of the preferred embodiment(s) is merely exemplary in nature and is in no way intended to limit the invention, its application, or uses.

Figure 1:
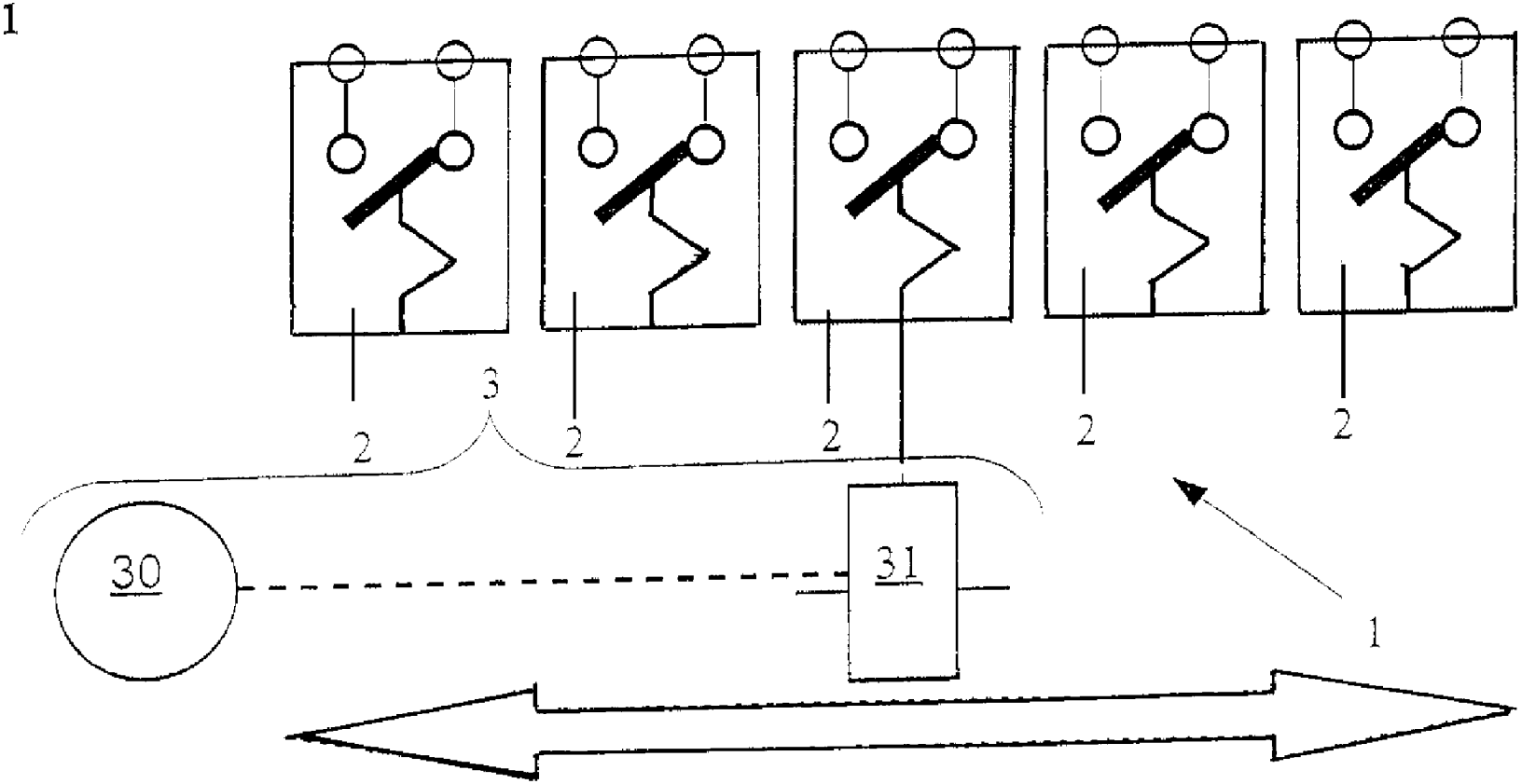
FIG. 1 is a schematic view of a switching implement according to the first design variant of the current invention.

FIG. 1 explains the basic principle of the current invention by showing a very much simplified view of a switching implement (1) according to a first design variant of the current invention. The switching implement (1) is specifically suitable for integration in a motor vehicle and contains multiple bistable switches (2) whose setting can be toggled between two logical states which makes them a suitable means of the remote-controlled actuation and, specifically, the remote-controlled switching on and off of electrical consumers connected to the bistable switches (2) following installation. The switching implement (I) also includes an actuating element (3) that is able to selectively change any of the bistable switches (2) to any of its two logical states.

In this design variant, the actuating element (3) consists of a means of activation (31) which, in this design variant, is a solenoid capable of activating the bistable switches (2). The actuating element (3) also contains a positioning device (30) for changing the position of the means of activation (31). In this design variant, the positioning device (30) consists of a drive for changing the position of the means of activation (31). The means of activation (31) is connected to the positioning device (30) which, in this design variant, is designed such that it will make the means of activation (31) perform a translational motion. The double arrow in FIG. 1 shows the possible directions of the translational motion the means of activation (31) can perform.

Using the positioning device (30) allows a selective motion of the means of activation (31) to any of the bistable switches (2). The means of activation (31) can then actuate the bistable switch (2) that was previously selected or that it was moved to and make the switch setting change from a first state to a second state or from the second state back to its first state. In this design variant, the setting of the bistable switches (2) is a non-contact operation performed by the means of activation (31) which, in this case, is a solenoid.

An alternative design not shown herein may include a means of activation (31) which operates such that one of its possible states is able to transport a mechanical effect from the positioning device (30) to one of the bistable switches and vice versa. In this alternative approach, the force required to change the setting of the bistable switch (2) would be exerted by the positioning device (30). To change the setting of the selected bistable switch (2), the means of activation (31) can be physically moved to that switch. There is also the possibility of the positioning device (30) moving the position of an actuator such that it can be operated by the means of activation (31) (possibly using another actuator) to actually operated the bistable switch (2).

Other alternative design variants of the switching implement (1) not shown herein either provide an option of the bistable switches (2) being arranged in two or more parallel or, if need be, opposing rows and the actuating element (3) and, specifically, the means of activation (31) being designed such that the different rows of bistable switches (2) can be selectively operated by means of the actuating element (3).

Figure 2:
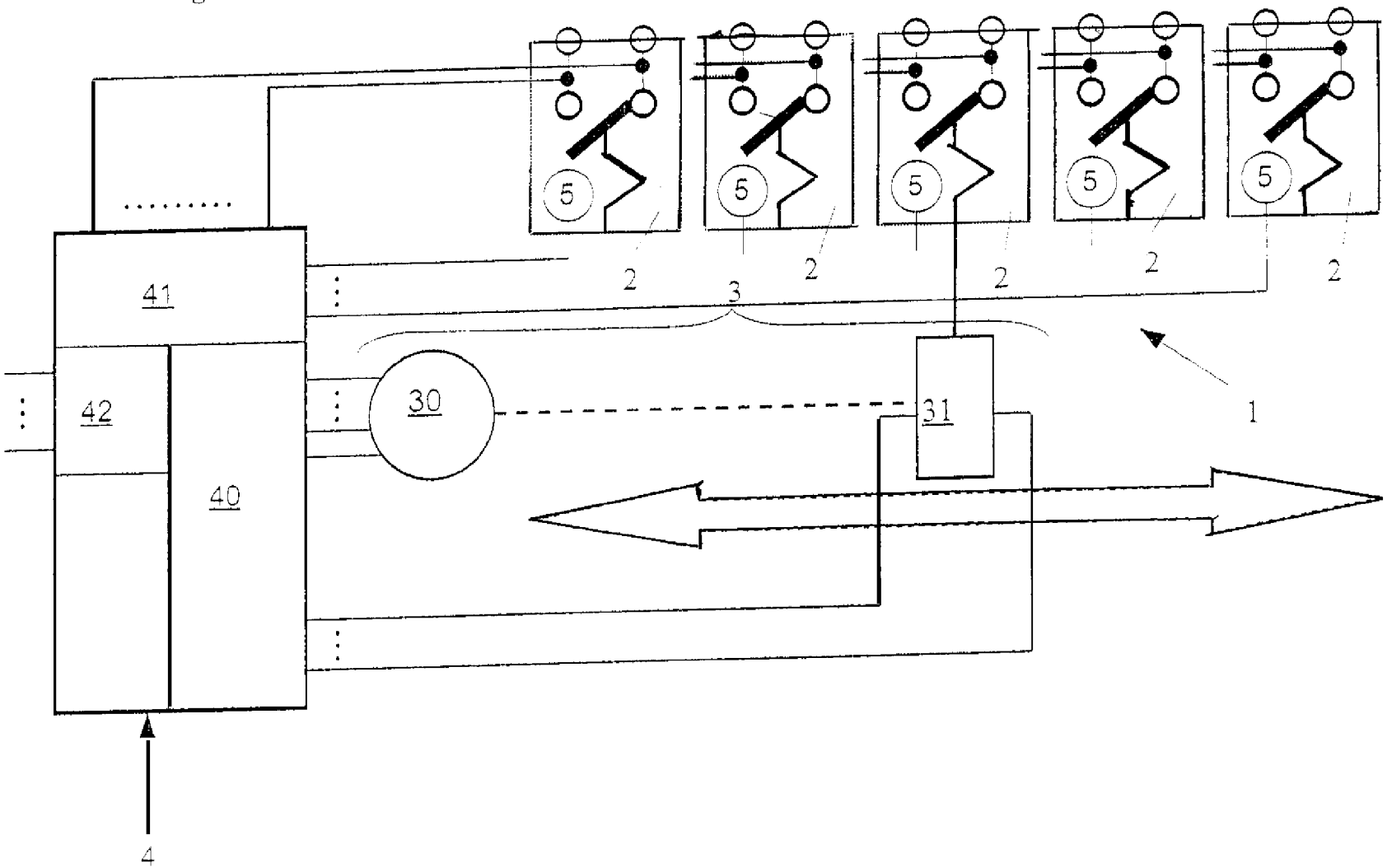
FIG. 2 is a schematic view of the switching implement shown in FIG. 1 plus an electronic control unit.

FIG. 2 shows the switching implement (1) from FIG. 1 as discussed in the text above, but equipped with an electronic control unit (4). The figure illustrates how the control unit (4) is connected to the actuating element (3) or to several actuating elements (3). The electronic control unit (4) contains drivers (40) to drive the actuating element(s) (3) and, in this design variant, means of processing (41) the sensor and pick-up signals. Sensor signals could be generated by a sensor element (5) inside the bistable switches (2), transferred to the electronic control unit (4), and processed there by the means of processing (41). In this design variant, the electronic control unit (4) is connected to an on-board mains of the vehicle through at least one communication port (42). When the communication port (42) transfers a request for switching on or off one of the bistable switches (2), the control unit (4) runs the drivers (40) to move the positioning device (30) to the appropriate bistable switch (2) to be actuated. The means of activation (31), possibly supported by the positioning device (30) as necessary, will actuate the bistable switch (2) to attain the requested target state. The electronic control unit (4) may be designed such that sensor signals delivered from within the bistable switches (2) and, possibly, other signals delivered by the sensor elements (5) which could measure the temperature inside the bistable switches (2), ambient temperatures, mains voltages and other variables will enable the control unit (4) to detect special operating conditions or failure modes of the bistable switches (2) and/or the wires or consumers connected to them to respond by actuating the affected bistable switch(es) (2) according to procedures defined in the control program of the electronic control unit (4). Failure modes may include short circuits, overloads, low voltages, arcing faults, etc. One feature of the electronic control unit (4) could be its ability to transfer fault messages to the vehicle's on-board mains that it previously received through the communication port (42). The sensor elements (5) can be installed inside or outside of the control unit (4) or inside or outside of the bistable switches (2). For example, the sensor elements (5) could be attached to an actuator of the bistable switch (2), an example of which is shown in FIG. 4*c*. The program of the control unit (4) could also include strategies for the handling of special situations during operation such as starting the vehicle, putting the vehicle out of operation, etc. Reading the load current could enable the electronic control unit (4) to transfer load current details to a top-level energy management system of the vehicle's on-board mains.

Figure 3:
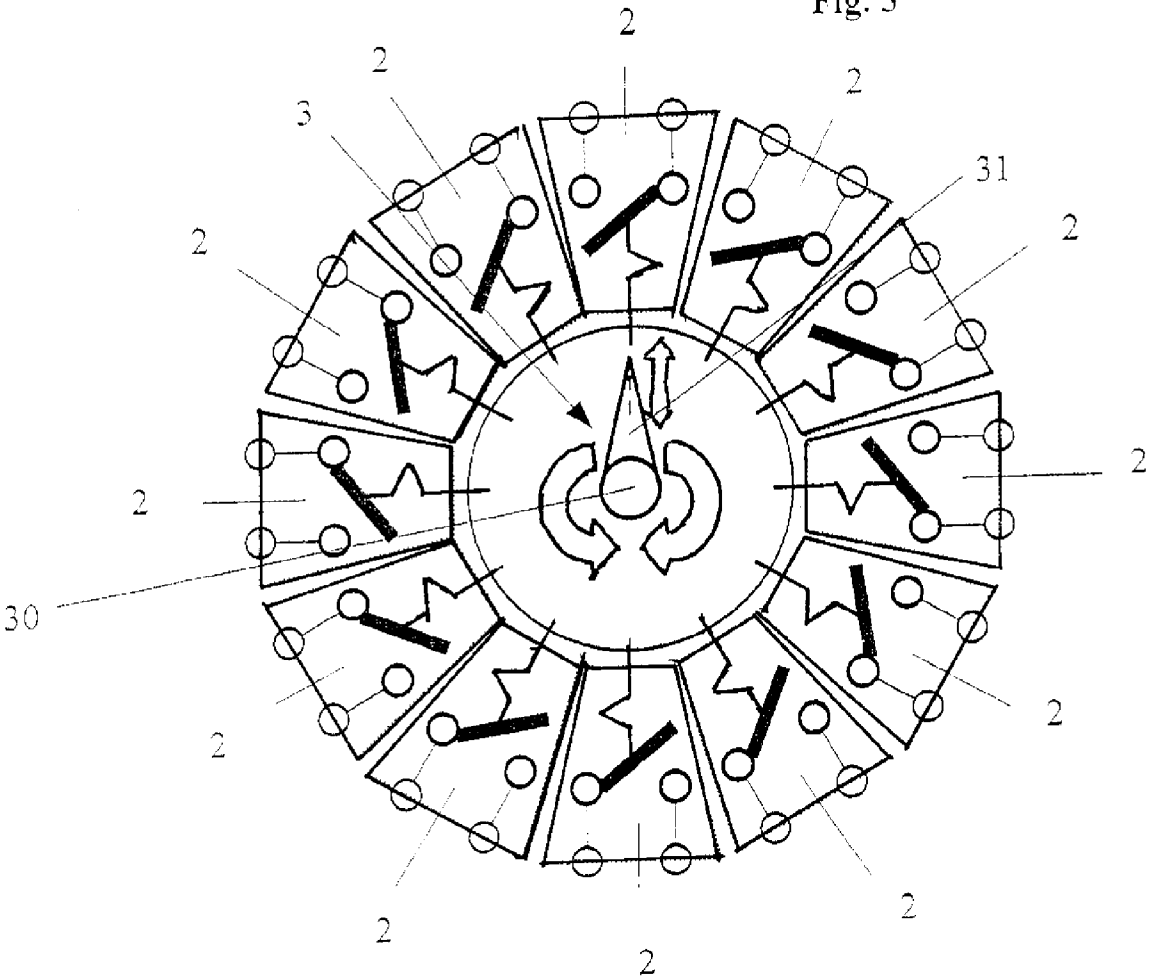
FIG. 3 is a schematic view of a switching implement according to a second design variant of the current invention.

FIG. 3 shows a very much simplified view of a second design variant of a switching implement (1). To maintain a clearer picture, the electronic control unit is not shown. The figure illustrates how this design variant is marked by multiple bistable switches (2) being arranged as a concentric circle. In this design variant, the actuating element (3) consists of a positioning device (30) or at least one actuator connected to the positioning device (30), where the actuator can be located inside, outside, above or below the bistable switches (2). As explained before when discussing the first design variant, the actuating element (3) also includes at least one means of activation (31) which can be used to selectively change the states of any of the bistable switches (2) of the switching implement (1). The figure illustrates that, in this design variant, the means of activation (31) can be moved in both a rotational and translational manner. As before, the arrows are indicative of the directions of movement.

The design variants described herein can use a linear drive or a rotational drive plus plunger coil solenoid or plunger armature solenoid as the positioning device (30), where the drive is collocated with a linear shifter if the bistable switches (2) are in a linear arrangement. The linear shifter can be a belt and chain drive, a worm drive or similar mechanism. The drives for the switching implements (1) described herein can be servodrives or stepper motors.

To actuate the drives, either the control unit (4) previously described when discussing the first design variant of the switching implement (1) or a position encoder plus control circuitry can be used.

In the design variants of the switching implement (1) shown herein, an appropriate drive or a single-coil or multiple-coil solenoid (perhaps together with a permanent magnet), an electrothermal, piezo-electric or other electrically operated drive can be used as the means of activation (31). The means of operating the bistable switches (2) can be levers, articulated straight-line guides, snap springs, pinions or similar elements.

Figure 4A:
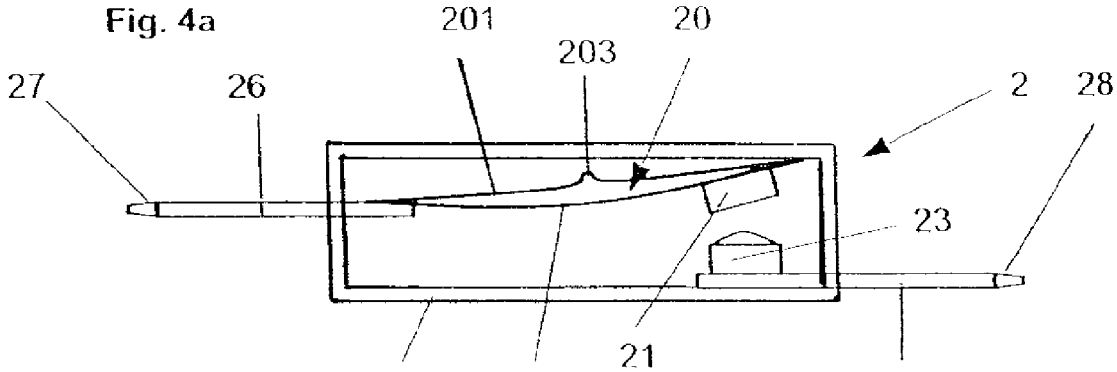
FIG. 4*a* is a lateral view of a first design variant of a bistable switch (open) for a switching implement.
Figure 4B:
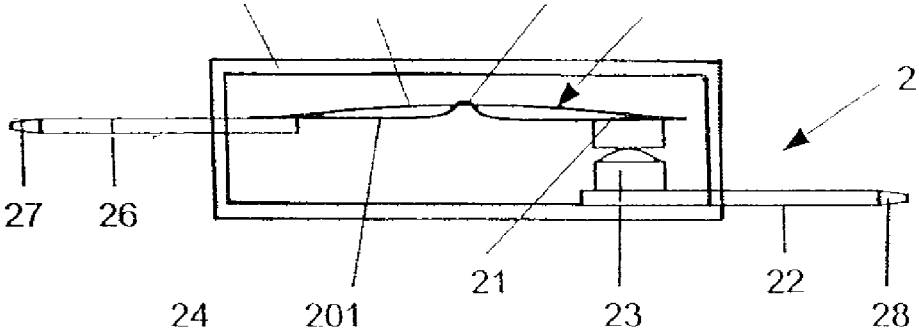
FIG. 4*b* is a lateral view of the bistable switch shown in FIG. 4*a*, but closed this time.
Figure 4C:
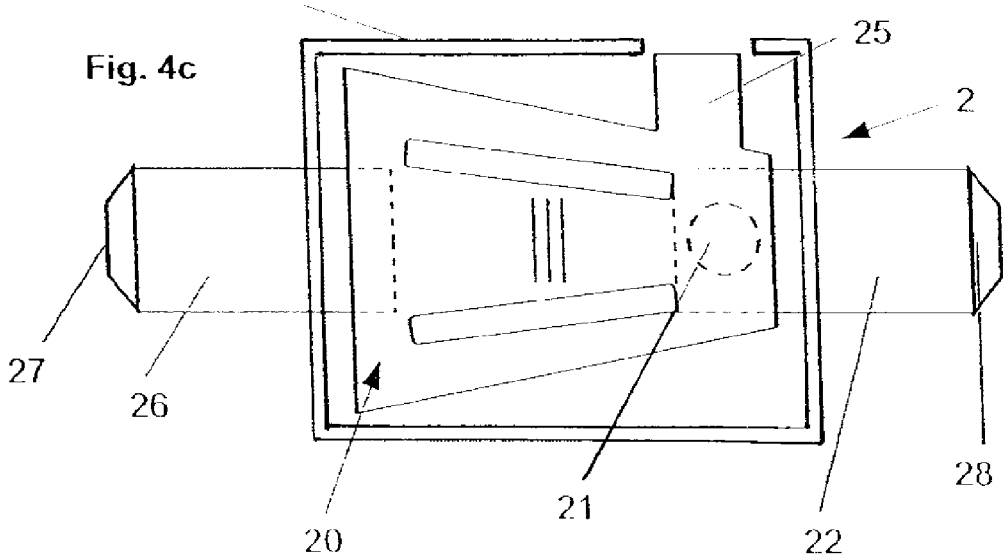
FIG. 4*c* is a top view of the bistable switch shown in FIG. 4*a* and FIG. 4*b*.

FIG. 4*a* to FIG. 4*c* shows a first design variant of a bistable switch (2) which can be used for the switching implements (1) discussed herein. FIG. 4*a* shows an open bistable switch (2), whereas FIG. 4*b* a closed switch. The bistable switch (2) consists of a moving switch contact holder (20) which, in this design variant, is a flexible switching contact spring plus at least one set switch contact holder (22). Other design variants of this bistable switch (2) may include one or several contact bridges or one or several rigid contact holders enabled to interact with one or several spring elements such that the bistable switch (2) can remain open or closed without any actuation from outside.

The moving switch contact holder (20) has at least one electrical switch contact (21). At least one other electrical switch contact (23) is connected to the set switch contact holder (22). The switch contacts (21, 23) can be contact elements riveted or welded on or any other surfaces enabled to act as a switch contact. For example, specially coated surface areas of the switch contact holders (20, 22) can be used as switch contacts (21, 23).

The bistable switch (2) also has a housing (24). The figure illustrates that the bistable switch (2) has a holder (26) for the moving switch contact holder (20) some of which protrudes from the housing (24) as does some of the set switch contact holder (22). There is an option of letting the holder (26) be an integral part of the housing (24). When the switch is closed as shown in FIG. 4*b*, the switch contacts (21, 23) make enough contact to allow an electric current to flow through them. When the switch is open as shown in FIG. 4*a*, the switch contacts (21, 23) are the specified distance away from one another.

The moving switch contact holder (20) and/or the spring elements acting upon this device include at least one means of operation which, when operated, will move the bistable switch (2) from one position to the other such that it could change states from 'closed' as shown in FIG. 4*b* to 'open' as shown in FIG. 4*a* or vice versa. In this design variant, the means of operation is an operative section (25) which is an integral part of the moving switch contact holder (20). FIG. 4*c* reveals that the operative section (25) can be accessed through an opening (no reference figure) in the housing (24). There is also a basic option of a non-positive interlock, for example by a ferromagnetic means of operation interacting with a magnetic force coming from the outside.

The switching contact spring which, in this design variant, makes up the moving switch contact holder (20) features at least two resilient sections (201, 202) and marked by a bead (203) or a shortening of at least one of the resilient sections (201, 202) distorting it in forward, transverse or across the direction of spring action such that the switching contact spring (20) can at least partially evade distortion by moving to one of two possible stable positions. FIG. 4*a* and FIG. 4*b* illustrate that the two stable positions of the moving switch contact holder (20) represent the open and closed positions of the bistable switch (2). To produce the bistable characteristic, it is also possible to make the switching contact spring with just a single resilient section and a deformation in itself (e.g., by a spherical cap).

The two switch contact holders (20, 22) or the holder (26) of the moving switch contact holder can be made of a single or multiple parts plus connectors (27, 28). To facilitate assembly, it is possible to make all or at least several of the contact elements from the same punching screen and to keep them separate during the process of assembly.

Figure 5A:
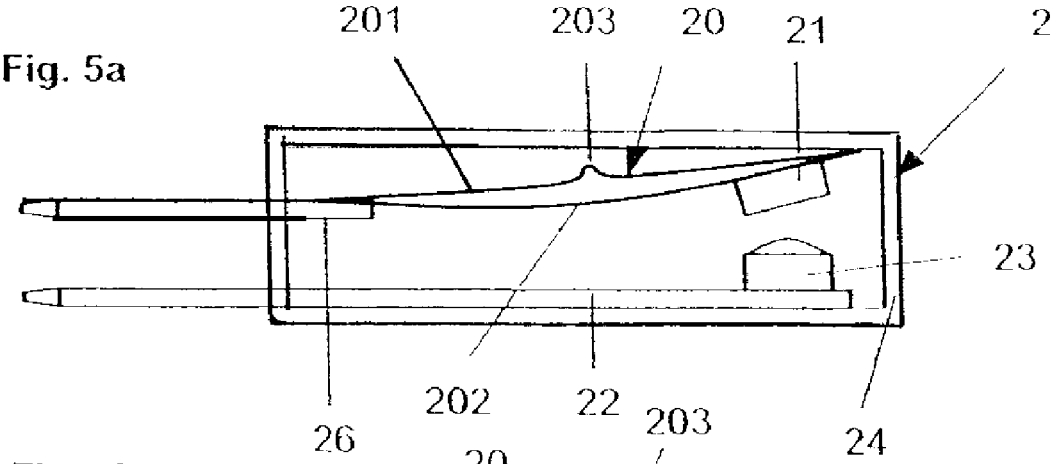
FIG. 5*a* is a lateral view of a second design variant of a bistable switch (open) for a switching implement.
Figure 5B:
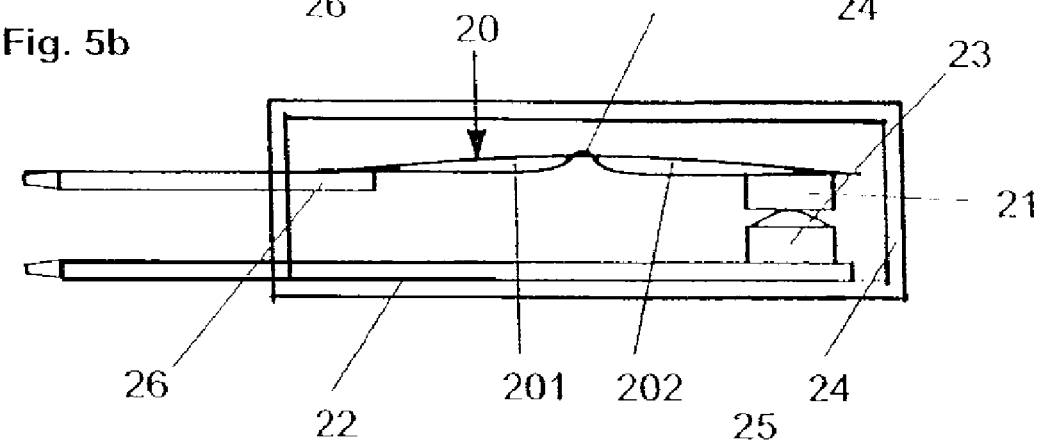
FIG. 5*b* is a lateral view of the bistable switch shown in FIG. 5*a*, but closed this time.
Figure 5C:
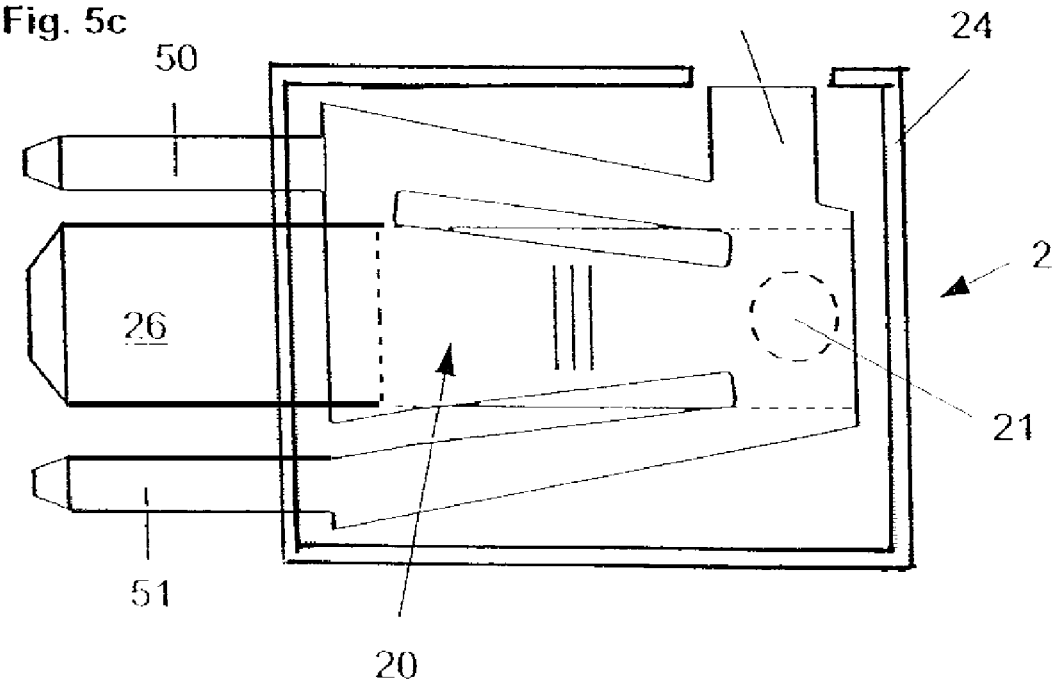
FIG. 5*c* is a top view of the bistable switch shown in FIG. 5*a* and FIG. 5*b*.

Apart from the connectors (27, 28) which are needed to carry the load current to the switch contact holders (20, 22), there can be additional connectors required for a low-interference electrical detection of the operating state of the bistable switch (2) (and specifically for measuring the load current). FIG. 5*a* to FIG. 5*c* show this kind of design variant of a bistable switch (2). One major difference between this and the design variant discussed earlier is that, in this case, two additional connectors (50, 51) come out of the housing (24) of the bistable switch (2).

Figure 6A:
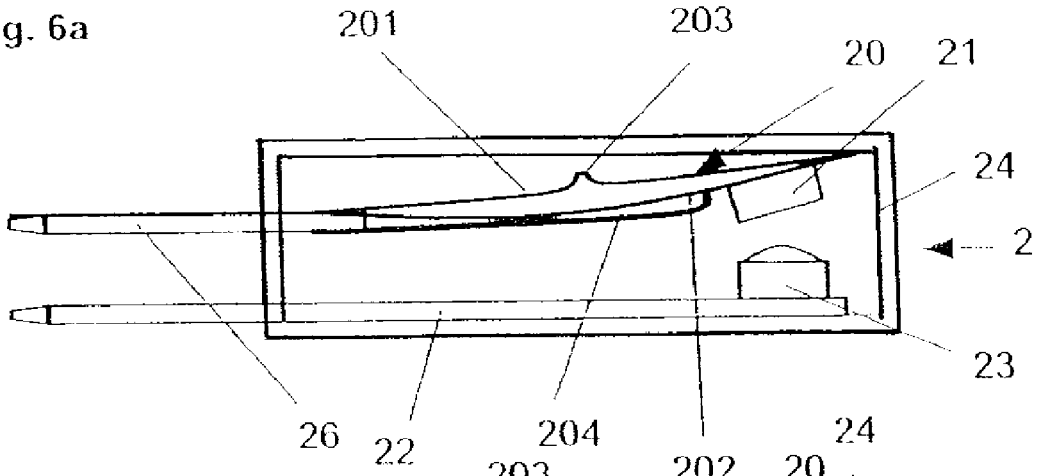
FIG. 6*a* is a lateral view of a third design variant of a bistable switch (open) for a switching implement.
Figure 6B:
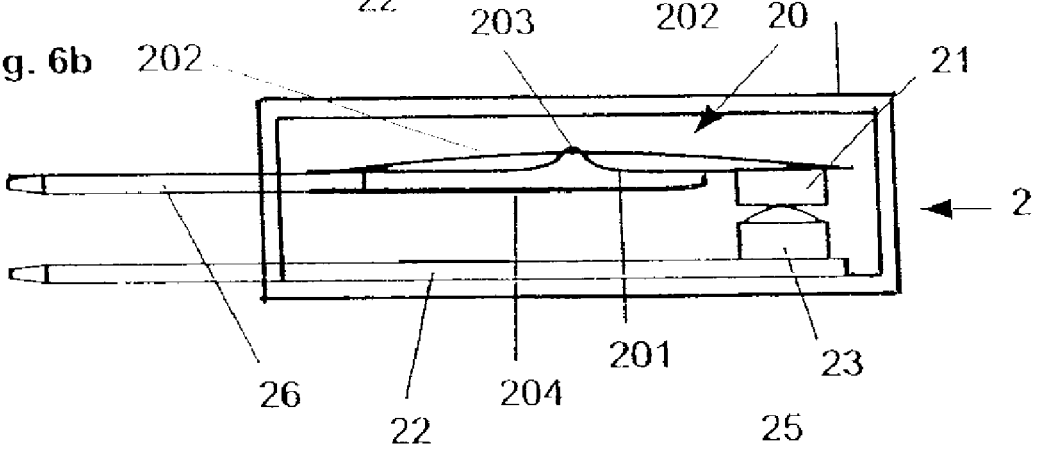
FIG. 6*b* is a lateral view of the bistable switch shown in FIG. 6*a*, but closed this time.
Figure 6C:
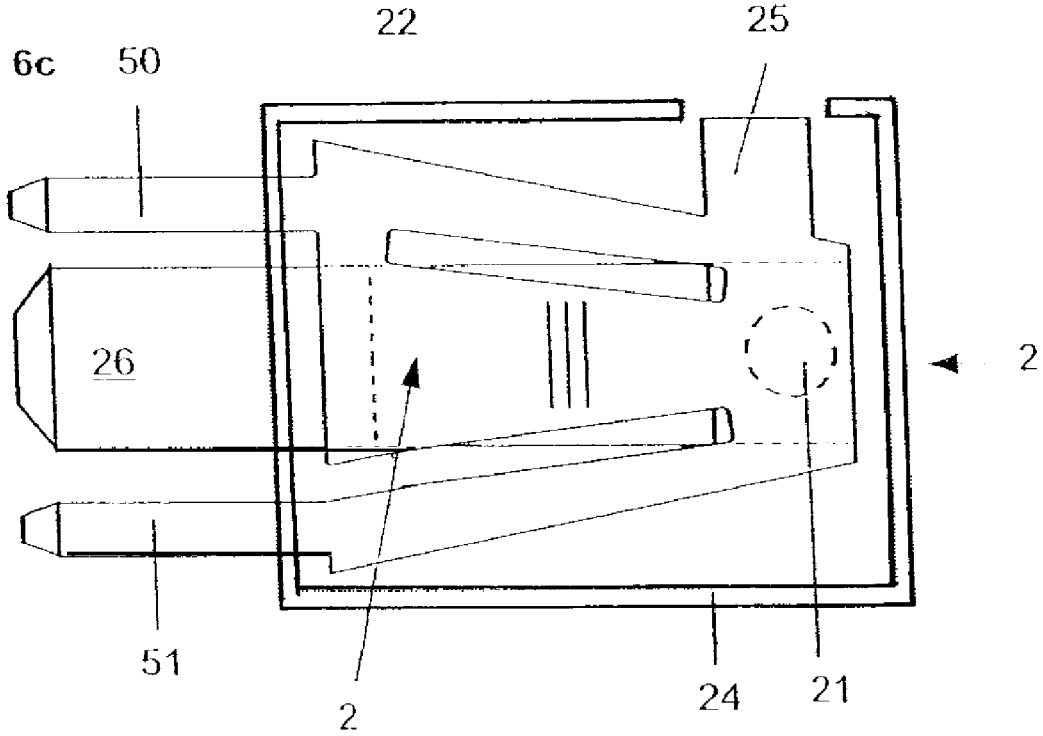
FIG. 6*c* is a top view of the bistable switch shown in FIG. 6*a* and FIG. 6*b*.

At least some of the bistable switches (2) of the switching implement (1) can be protected by safety equipment enabled to automatically open a bistable switch (2) to interrupt the flow of electric current if an admissible temperature or an admissible maximum flow of electric current through the bistable switch (2) is exceeded. FIG. 6*a* to FIG. 6*c* shows a bistable switch (2) with this kind of protective equipment. In this design variant, the bistable switch (2) features an additional thermo-bimetal trigger element (204) attached to the holder (26) of the moving switch contact holder (20) and mainly going alongside the moving switch contact holder (20). The thermo-bimetal trigger element (204) is designed such that, if the temperature becomes too high, it will contact the moving switching contact holder (20) in the shape of a switching contact spring, thereby triggering the switching contact holder (20) which will cause the bistable switch (2) to open. In an alternative design, the safety equipment may also include a permanent magnet which may be linked to the moving switch contact holder (20). In this case, the magnetic field of the permanent magnet will be repelled by the magnetic field generated by an excessive load current which will cause the permanent magnet (if necessary assisted by an additional trigger) to generate a triggering force that will affect the moving switch contact holder (20) and make it move to the 'open' position.

Figure 7A:
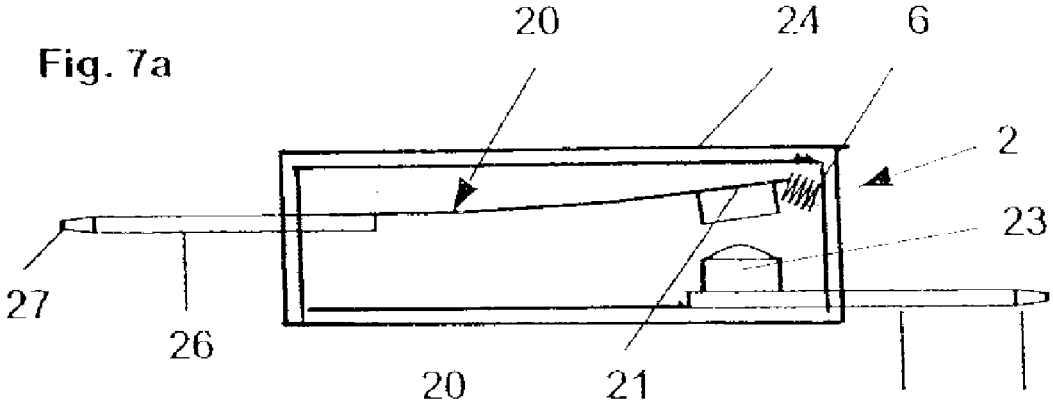
FIG. 7*a* is a lateral view of a fourth design variant of a bistable switch (open) for a switching implement.
Figure 7B:
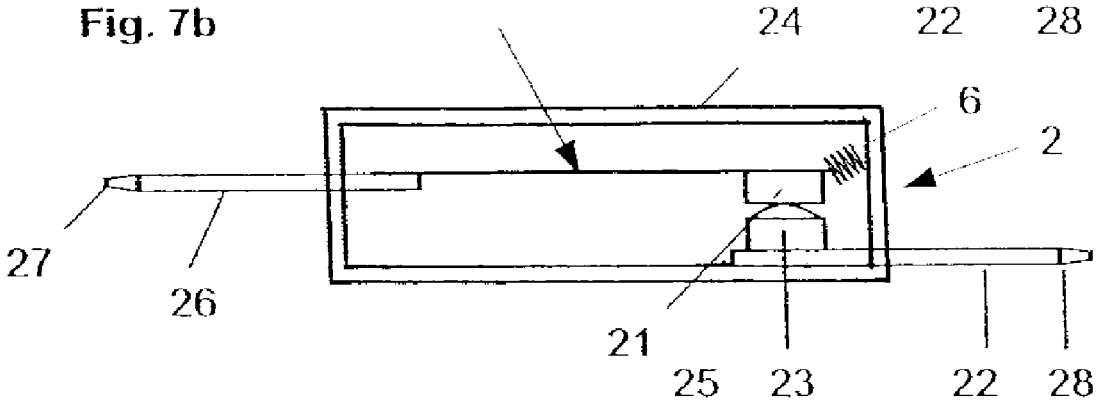
FIG. 7*b* is a lateral view of the bistable switch shown in FIG. 7*a*, but closed this time.
Figure 7C:
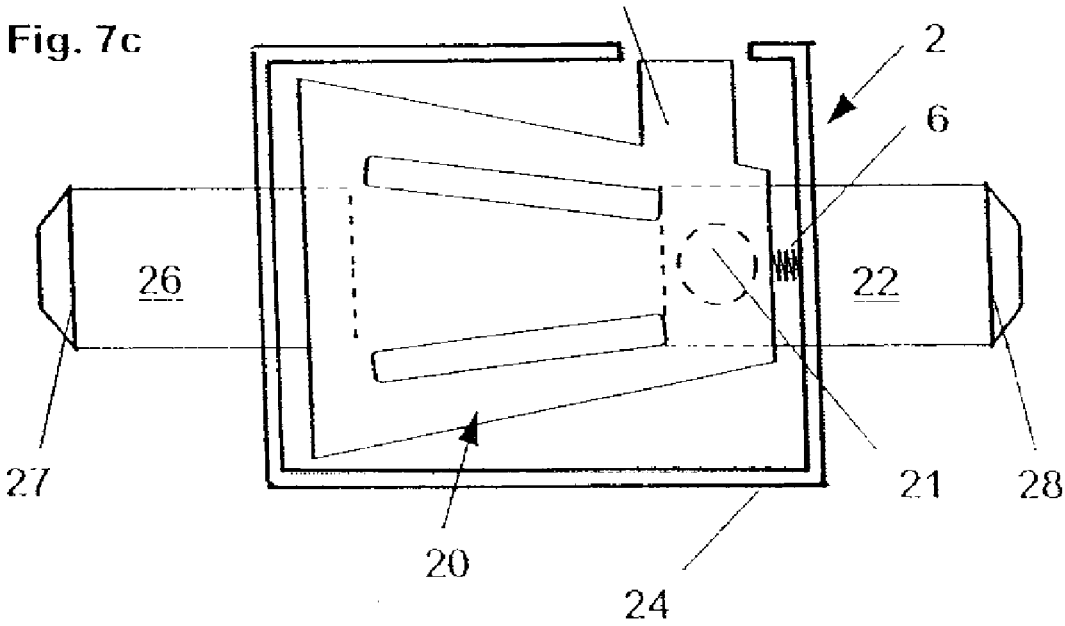
FIG. 7*c* is a top view of the bistable switch shown in FIG. 7*a* and FIG. 7*b*.

FIG. 7*a* to FIG. 7*c* shows another design variant of a bistable switch (2) which can be used for the switching implements discussed herein. The figures illustrate how the bistable switch (2) includes a spring element (6) attached to an inside wall of the housing (24) and protruding from it towards and contacting a free end of the moving switch contact holder (20) which is shaped like a switching contact spring. FIG. 7*a* to FIG. 7*c* suggests that the spring element (6) can be either a spiral, or flat or wire-shape spring.

In the design variants of the bistable switch (2) described herein, the outgoing connectors (27, 28, 50, and 51) of the switch contact holders (20, 22) are blade connectors. Alternatively, they can be designed as soldered joints, press-fit connectors, plug-type sleeves or similar connectors of this kind. The connectors (27, 28, 50, 51) can point away from the housing (24) in any direction.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A switching implement designed for the remote-controlled switching of electrical components comprising:

multiple electromechanical, bistable switches each of which can be set to a first state and at least a second state and vice versa;

at least one actuating element said actuating element being configured to selectively set any one of the bistable switches to one of said first or second states;

said switches and said actuating element being mounted on a single module;

said switches being actuable only by said actuating element;

an electronic control unit configured to control the at least one actuating element in response to receipt of external control signals;

the at least one actuating element having at least one activator and at least one positioning device for the at least one activator;

the switching implement having a sensor element enabled to measure at least one of a temperature of the bistable switches and an electric current going through the bistable switches;

at least some of the bistable switches being equipped with a protection element disposed to turn off the bistable switch if at least one of a maximum temperature and a maximum current are exceeded.

2. The switching implement as in claim 1, wherein the at least one actuating element is designed such that it can make two entirely independent movements that will allow toggling each of the bistable switches to any of its logical states.

3. The switching implement as in claim 1, wherein the at least one actuating element is designed to perform a non-contact toggling of states of the bistable switches.

4. The switching implement as in claim 1, wherein the bistable switches have at least one operating mode which is enabled to contact the at least one activator of the actuating element.

5. The switching implement as in claim 1, wherein the at least one activator is a solenoid.

6. The switching implement as in claim 1, wherein the protection element consists of a bimetal actuator located inside the bistable switch or attached immediately to the bistable switch.

7. The switching module of claim 1, wherein said protection element is a thermo-bimetal trigger element.

8. The switching implement as in claim 1, wherein the switching implement includes a thermometer to measure an ambient temperature of the bistable switches as well as a thermometer to measure a mains temperature of a vehicle's on-board mains, where both then thermometers are connected to the electronic control unit.

9. The switching module of claim 1 having at least three switches.

10. The switching module of claim 1 further comprising said actuating element moving among selected switches by at least one of translation or rotation.

11. The switching module of claim 1 further comprising said actuating element having an electrothermal, piezo-electric or other electrically operated drive as an activator.

12. The switching module of claim 1 further comprising operating the bistable switches by at least one of a lever, an articulated straight-line guide, a snap spring, or a pinion.

13. The switching module of claim 1 further comprising said module having a communication port mounted to said module such that said module may receive signals from vehicle components outside said module.

14. The switching module of claim 1 further comprising said module having a communication port mounted to said module such that said module may receive signals from vehicle components outside said module.

15. The switching module of claim 1 further comprising each of said bistable switches being deployed as both a fuse and a relay.

16. A relay/fuse module for a vehicle comprising:

an actuator;

a first switch disposed to be in a first circuit and a second switch disposed to be in a second circuit, each of said switches having a first state and a second state;

said switches being changed from said first state to said second state by said actuator in response to receipt by said actuator of an electric actuate signal;

a positioning device, said positioning device being disposed to selectively position said actuator to be in actuating communication with any of said switches to actuate switching from said first state to said second state;

said selective positioning of said positioning device being in response to an electric move signal;

a controller configured to selectively send said actuating signal and said move signal such that any of the circuits may be turned on or off;

said controller being in operative communication with a sensor for receiving a signal from said sensor;

said controller being further configured to signal said actuator to turn the first circuit off in response to the signal from said sensor;

said switches, said actuator and said positioning device all being contained within a single housing to comprise a module.

17. The relay/fuse module of claim 16, wherein said controller is further configured to turn on the second circuit in response to said sensor signal by signaling said position device to move and signaling said actuator to actuate.

18. The relay/fuse module of claim 16, wherein said controller is also incorporated within said module.

19. The relay/fuse module of claim 16, wherein at least one of said switches incorporates a bi-metal trigger such that said switch comprises a heat responsive fuse operative to interrupt a circuit in response to a temperature above a threshold.

20. The relay/fuse module of claim 16, wherein said positioning device is moved by a motor.

* * * * *